United States Patent [19]

Sagner et al.

[11] 4,072,170

[45] Feb. 7, 1978

[54] PRESSURE-RELIEVING DEVICE FOR STEAM GENERATORS AND THE LIKE

[75] Inventors: Max Sagner, Paris; Jacques Souquet, Le Chesnay, both of France

[73] Assignee: Bertin & Cie, Plaisir, France

[21] Appl. No.: 692,517

[22] Filed: June 3, 1976

[30] Foreign Application Priority Data

June 3, 1975 France ..... 75 17249

[51] Int. Cl.[2] ..... F01N 1/14; F15D 1/08

[52] U.S. Cl. ..... 137/599; 137/604; 138/42; 181/265; 239/397.5; 239/590.3; 285/187

[58] Field of Search ..... 239/120–122, 239/397.5, 567, 590.3, 590.5; 138/39, 42; 137/625.28, 625.3, 312, 314, 599, 604; 181/53, 60, 69; 285/187

[56] References Cited

U.S. PATENT DOCUMENTS

| | | | |
|---|---|---|---|
| 1,412,865 | 4/1922 | Harter | 137/314 |
| 1,489,628 | 4/1924 | Bricker | 181/53 |
| 1,631,438 | 6/1927 | Sullivan | 137/314 |
| 3,635,309 | 1/1972 | Nemcansky et al. | 181/69 X |
| 3,645,092 | 2/1972 | Tatsutomi et al. | 285/187 X |

*Primary Examiner*—John J. Love
*Assistant Examiner*—Andres Kashnikow
*Attorney, Agent, or Firm*—A. W. Breiner

[57] ABSTRACT

The pressure in a high-pressure steam boiler or other pressure fluid tank is occasionally relieved by means of a discharge device having a pressure-relief valve mounted on an ejection conduit opening into a hood connected to a discharge conduit. A break in continuity is provided between this ejection conduit and this hood in order to allow relative movements thereof under thermal expansion; furthermore the ejection conduit opens into the hood through a generally transversely directed nozzle system so that the jet issuing therefrom has a zero or negligible axial velocity component.

7 Claims, 3 Drawing Figures

PRESSURE-RELIEVING DEVICE FOR STEAM GENERATORS AND THE LIKE

When operating at full load, the high-capacity boilers of certain industrial plants produce high outputs of strongly superheated steam to feed motors or other receivers designed to meet the demand at peak periods. By definition the latter are only temporary and, after they have passed, that is to say on entering a trough period, one or more steam receivers are taken out of service and the feed to them is cut off.

Now whereas such interruption can be near instantaneous, this is not so for the drop in boiler operating conditions. This makes it necessary to relieve the heavy output of superheated steam which they continue to deliver for a certain time, and the practice is accordingly to open pressure-relief valves mounted on exhaust pipes which generally debouch into the open air through chimneys. Owing to the expansions which occur in the exhaust pipes and the resulting thermal stresses, it is necessary to provide breaks in continuity thereon that form expansion joints, hereinafter referred to as "hoods".

FIG. 1 in the accompanying drawings, which schematically illustrate a conventional arrangement, shows a boiler manifold 1 the pressure-relief valve 2 of which is mounted on an exhaust conduit 3 having port under a hood 4 which is equipped at its inlet end with a free-valve-forming floating plate 5 and which is followed by a flue 6 of larger diameter, to permit free expansion of the various components.

Experience has shown that in cases where a very rapid pressure-relieving is required, that is to say for a large opening of valve 2, the exhaust pipes are sometimes the seat of excessive mechanical stresses liable to cause fracturing or unsealing.

This drawback has been attributed to the aerodynamic loads exerted by the incoming steam in the region of the hood. For indeed the exhaust conduit 3 behaves like a jet nozzle and therefore tends to move back (i.e. towards the bottom of FIG. 1).

The present invention has for its object an arrangement designed to considerably reduce the mechanical stresses in question, though without introducing modifications necessitating a reconstruction of existing plants. On the contrary, one of the most appreciable advantages of the improvement afforded by the present invention is that of being adaptable as an accessory to existing plants, which can thus be retained virtually intact so to speak.

In accordance with this invention, the exhaust conduit of the pressure-relief valve is caused to debouch via a nozzle system of more or less transverse orientation whereby to cause the steam jet issuing therefrom to have a zero or negligible axial velocity component. This system preferably includes a plurality of transverse nozzles each capable of engendering elemental thrusts which balance each other out so that their resultant be null or at most very small. These transverse nozzles are to that end preferably orientated in opposite directions so that their respective individual thrusts cancel one another out. Manifestly, the same result could be obtained by substituting an uninterrupted slit for said plurality of nozzles.

In a preferred embodiment of the present invention, such system takes the general form of an annular strainer or of a ring with multiple nozzles distributed around its periphery and discharging steam in a plurality of centrifugal radial directions, such ring being welded for example to the end of the exhaust conduit.

The exhaust conduit may possibly be provided with an axial outlet at its free end disposed within the hood in order to discharge thereinto a fraction of the pressure-relieving flow along the axis of the exhaust conduit, but it would appear preferable to block off the free end thereof with an end-face in order to prevent any axial emission of the fluid. In said preferred embodiment having a ring of radial nozzles, the ring may be fast with said axial-obturation end-face.

The nozzle system of the present invention preferably cooperates with an annular duct operating after the manner of a steam-jet air ejector or extractor that generates a slight vacuum or negative pressure relative to atmospheric pressure in order to prevent backflow of the steam through the clearance needed to permit free movement and eliminate the force resulting from the effect of the pressures on the ejection conduit. The air ejector or the hood can be equipped with deflecting vanes opposite which the nozzle system has ports and which are so arranged as to deflect the steam issuing transversely into the hood, downstream in the direction of the flue, thus averting the full force of the steam jet on the normal walls and taking advantage of the kinetic energy of the steam to improve the exhaust flow conditions.

The provision of an annular conduit of near constant section between the other part of the air ejector and the hood will improve operating conditions when the diameter available for the hood is insufficient to ensure proper mixing of steam jets and entrained air.

The description which follows with reference to the accompanying nonlimitative exemplary drawings will give a clear understanding of how the invention can be carried into practice.

In the drawings:

FIG. 1 schematically illustrates a conventional arrangement of the kind referred to in the preamble;

Figure 2:
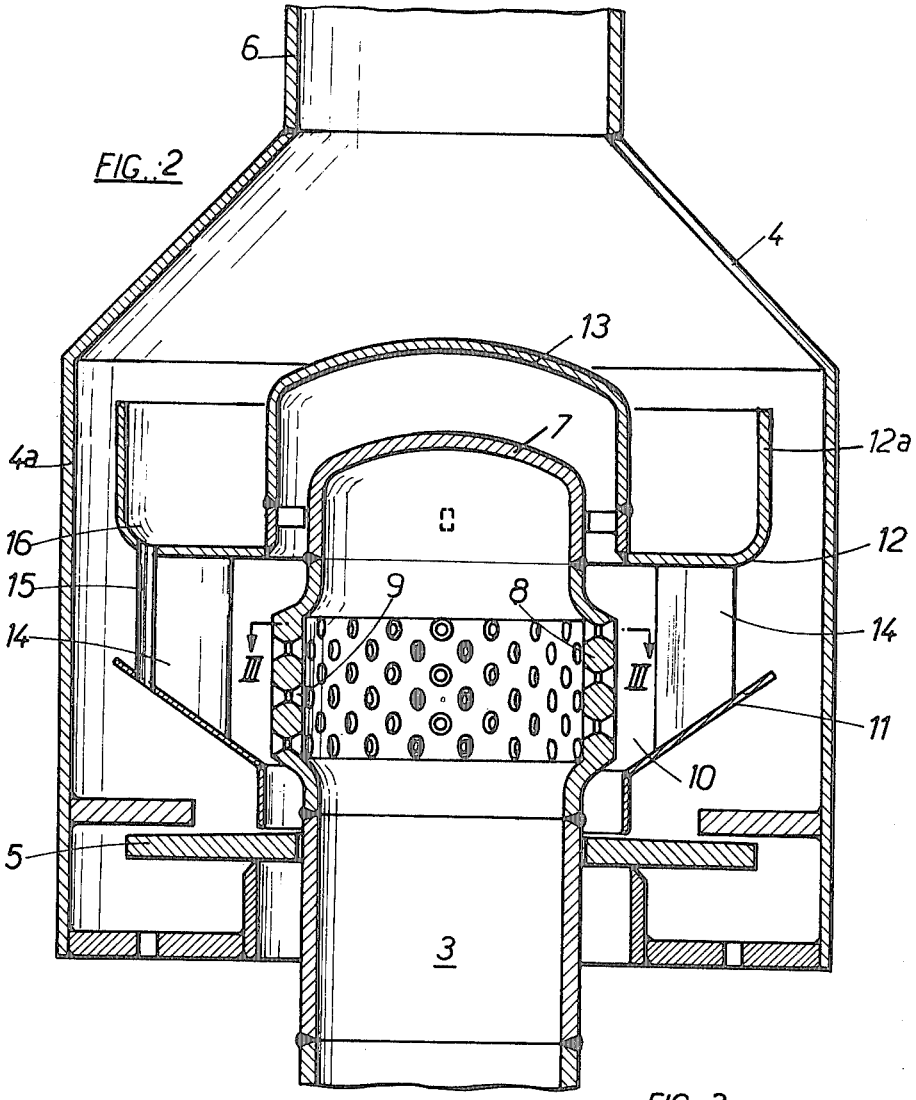
FIG. 2 is a fragmental view in axial section of an embodiment of the present invention.
Figure 1:
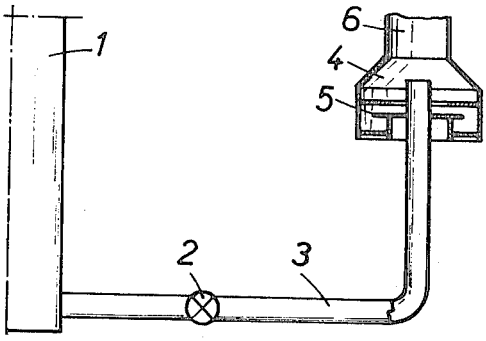

FIG. 2 again shows the exhaust conduit 3 for the pressure-relief valve, and the hood 4 which is connected to flue 6 and which houses the floating-plate system 5 in the conventional arrangement. In contrast to the latter, however, the free end of exhaust conduit 3 does not have port in the direction of flue 6 but is instead blocked off by an end-face 7 which prevents an axial exit path for the steam conveyed through exhaust conduit 3.

Figure 3:
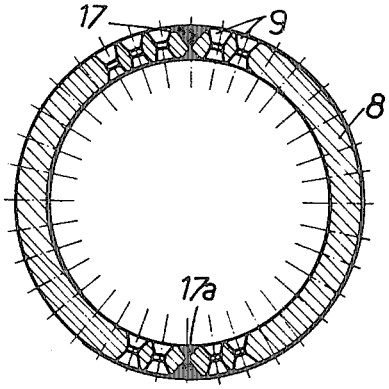
PRIOR ART FIG.:3
FIG. 3 is a view in cross-section through the line III—III of FIG. 2.

End-face 7 is fast with a ring 8 (see also FIG. 3) in which are formed cannularly-distributed radial nozzles 9 of convergent-divergent configuration distributed around the ring in several successive rows, it being possible for diametrically opposed nozzles either to lie in the same transverse plane or else to be staggered as shown in FIG. 2.

The nozzles 9 have port in an annular duct 10, and the whole unit can be likened to an air ejector or extractor with multiple steam jets. This duct is bounded by an inclined wall 11 which extends opposite the nozzles 9 and operates as a deflector for deflecting the horizontal steam jets upwardly. The opposite wall 12 of annular duct 10 is fast with a bell 13 which surmounts end-face 7 and permits free expansion of the end of exhaust conduit 3. The two opposite walls 11 and 12 of annular duct 10 are joined by streamlined arms 14 for housing one or more pipes 15 to permit draining towards the bottom of hood 4 of the condensation water collected in the gutter 16 formed by the upper wall 12 of the duct.

It should be noted that, in addition to the previously described advantages from the aerodynamic and strength-of-materials standpoint, the subject device of this invention provides an appreciable silencing effect as a result of the splitting of the steam outflow performed by the nozzle 9 and by the dilution of this outflow in mixer 10.

In the illustrated example said duct includes a radial portion bounded by walls 11 and 12 and a longitudinal portion of substantially constant area bounded by a cylindrical extension 12*a* of wall 12 and by the cylindrical part 4*a* of hood 4. This ensures adequate air-and-steam mixture length within a small overall diameter.

The convergent-divergent nozzles 9 are the most effective type for picking up a maximum of expansion energy and permit optimum delivery into a possibly long and/or narrow flue 6. The pattern of change in the cross-section of such nozzles is easy to calculate from the familiar laws of gas expansion at sonic flow speeds.

On the other hand, such nozzles are relatively difficult to machine and, notably for obtaining the convergent section, it may be necessary to devise the ring 8 in two half-shells joined together by welds 17, 17*a* (FIG. 3) after the nozzles 9 have been machined.

It is also possible, without great loss of efficiency, to adopt solely divergent nozzles, and possibly even cylindrical nozzles.

An alternative embodiment of a substantially transversely orientated nozzle according to this invention consists in stacking, end to end, in the manner well-known per se, ring-shell elements with which to form the ring 8. If the ends of these shell-rings are formed with radial milled portions, the latter become circular or rectangular nozzles such as the nozzles 9 subsequent to assembly. Alternatively, said shell-rings can retain ends obtained by revolution and be stacked with a certain spacing therebetween that determines the nozzle, the latter being accordingly a continuous annular slit.

The shell-rings can be stacked for example by means of bolted tie-rods which hug the shell-rings between bell 13 and exhaust conduit 3, as well-known to the specialist in the art.

It goes without saying that applications of this invention are not limited to the pressure-relieving of steam generators but extend likewise to the total or partial emptying of any kind of reservoir containing gas at high pressure.

However, this invention finds its most useful application in improving the safety features of nuclear reactors in which the moderating and cooling agent is water or steam under pressure. Indeed a sudden shutdown in the event of an incident would produce a very marked pressure drop in such agent, and experience has shown that the subject device of this invention will permit satisfactory discharge of steam at a high output rate, whereas prior art devices produce such strains in the discharge piping that both the latter and the building housing it could be destroyed.

We claim:

1. A fluid discharge system for relieving pressure in a high-pressure steam boiler or like reservoir, of the kind comprising a discharge fluid collecting flue hood and a valve-controlled exhaust conduit having an upstream end connected to said reservoir and a downstream end opening into said hood, said conduit and hood being mechanically separate from each other by a break in continuity to allow some relative movement upon fluid action thereon, wherein the improvement comprises the provision of an air ejector assembly overridden by said hood and fluidically associating the same to said exhaust conduit, said assembly comprising a nozzle device fitted at said exhaust conduit downstream end and designed to issue pressure fluid therefrom in thrust-balanced high-velocity jet form, and a duct device opening inside said hood and registering with said nozzle device, whereby the high-velocity jet issuing therefrom entrains air through said duct device and thence through said hood.

2. System as claimed in claim 1, wherein said nozzle device comprises a nozzle bearing ring generally coextensive and coaxial with said exhaust conduit downstream end and secured thereto, said nozzle bearing ring having a centrifugally-radiating nozzle orientation generally transverse to the common axis of said nozzle bearing ring and exhaust conduit downstream end.

3. System as claimed in claim 2, wherein said nozzle bearing ring is formed with a multiplicity of radiating elemental nozzles in cannular distribution thereon.

4. System as claimed in claim 3, wherein said elemental nozzles have at least partly a divergent configuration.

5. System as claimed in claim 4, wherein said elemental nozzles have a convergent-divergent configuration.

6. System as claimed in claim 2, wherein said duct device comprises a generally radial annular fore section extending around said nozzle bearing ring, and a generally longitudinal annular aft section following said radial fore section.

7. System as claimed in claim 6, wherein said duct device comprises a jet deflector surface in said radial fore section fitted to deflect radially issuing jet fluid towards said longitudinal aft section.

* * * * *